US011370243B2

(12) United States Patent
Hori

(10) Patent No.: US 11,370,243 B2
(45) Date of Patent: Jun. 28, 2022

(54) APPLICATOR WITH GAS-LIQUID EXCHANGING SECTION AND OCCLUDING BODY

(71) Applicant: 3S CORPORATION, Saitama (JP)

(72) Inventor: Eiji Hori, Saitama (JP)

(73) Assignee: 3S CORPORATION, Saitama (JP)

( * ) Notice: Subject to any disclaimer, the term of this patent is extended or adjusted under 35 U.S.C. 154(b) by 129 days.

(21) Appl. No.: 16/841,620

(22) Filed: Apr. 6, 2020

(65) Prior Publication Data

US 2020/0230996 A1 Jul. 23, 2020

Related U.S. Application Data

(63) Continuation of application No. PCT/JP2018/031278, filed on Aug. 24, 2018.

(30) Foreign Application Priority Data

Oct. 11, 2017 (JP) ..... JP2017-197423
Apr. 9, 2018 (JP) ..... JP2018-074715

(51) Int. Cl.
*B43M 11/06* (2006.01)
*B43K 8/08* (2006.01)
(Continued)

(52) U.S. Cl.
CPC ..... *B43K 8/08* (2013.01); *A45D 34/04* (2013.01); *B43K 8/03* (2013.01); *B43K 8/06* (2013.01); *A45D 2200/1072* (2013.01)

(58) Field of Classification Search
CPC ..... B43K 8/04; B43K 8/06; B43K 8/08
(Continued)

(56) References Cited

U.S. PATENT DOCUMENTS 6,089,776 A 7/2000 Kaufmann
6,095,707 A 8/2000 Kaufmann
(Continued)

FOREIGN PATENT DOCUMENTS

CN 1972812 A 5/2007
CN 101073963 A 11/2007
(Continued)

OTHER PUBLICATIONS

Extended European Search Report in EP Application No. 18865857.9, dated May 14, 2021, 9pp.
(Continued)

*Primary Examiner* — Jennifer C Chiang
(74) *Attorney, Agent, or Firm* — Hauptman Ham, LLP

(57) ABSTRACT

An applicator includes a partition wall for partitioning between a storage chamber and a reservoir chamber, an application body that allows application of a liquid stored in the storage chamber, a relay member that transfers the liquid stored in the storage chamber passing through the partition wall toward the application body, a gas-liquid exchanging section formed at the partition wall for air-liquid exchanging with the liquid stored in the storage chamber, an occluding body that is disposed in the reservoir chamber, and in contact with the relay member for occluding the liquid, and a movement prevention section disposed at the relay member and/or the occluding body for preventing movement of the liquid held in the occluding body to the relay member.

21 Claims, 15 Drawing Sheets

(51) Int. Cl.

| | |
|---|---|
| ***A45D 34/04*** | (2006.01) |
| ***B43K 8/03*** | (2006.01) |
| ***B43K 8/06*** | (2006.01) |

(58) Field of Classification Search
USPC ..... 401/198, 199
See application file for complete search history.

(56) References Cited

U.S. PATENT DOCUMENTS

| | | | | |
|---|---|---|---|---|
| 6,322,268 | B1 | 11/2001 | Kaufmann et al. | |
| 6,336,762 | B1 | 1/2002 | Oike | |
| 6,416,242 | B1 | 7/2002 | Kaufmann | |
| 9,688,092 | B2 * | 6/2017 | Niwa | B43K 8/02 |
| 9,694,620 | B2 * | 7/2017 | Chu | B43K 8/06 |
| 2001/0016142 | A1 | 8/2001 | Koyama | |
| 2002/0057940 | A1 | 5/2002 | Kaufmann | |
| 2005/0249542 | A1 | 11/2005 | Hori | |
| 2008/0063463 | A1 | 3/2008 | Hori | |
| 2013/0004231 | A1 * | 1/2013 | Nakatani | B43K 8/02 401/198 |
| 2015/0063894 | A1 | 3/2015 | Wen et al. | |
| 2017/0001465 | A1 | 1/2017 | Chu | |

FOREIGN PATENT DOCUMENTS

| | | | |
|---|---|---|---|
| CN | 103465684 | A | 12/2013 |
| EP | 3112181 | A1 | 1/2017 |
| JP | H6-510491 | A | 11/1994 |
| JP | 2000-233592 | A | 8/2000 |
| JP | 2001-287493 | A | 10/2001 |
| JP | 2002-326488 | A | 11/2002 |
| JP | 2007-111885 | A | 5/2007 |
| JP | 2010-89383 | A | 4/2010 |
| JP | 3201277 | U | 12/2015 |
| JP | 6042005 | B1 | 12/2016 |
| JP | 6155408 | A | 6/2017 |
| WO | 2004/000575 | A1 | 12/2003 |

OTHER PUBLICATIONS

International Search Report in PCT Application No. PCT/JP2018/031278, dated Dec. 4, 2018, 4pp.
Office Action in JP Application No. 2019-537004, dated Dec. 19, 2019, 17pp.
Office Action in JP Application No. 2019-537004, dated Mar. 5, 2020, 9pp.
Office Action in JP Application No. 2019-537004, dated May 7, 2020, 22pp.
Office Action in CN Application No. 201880064585.X, dated Mar. 10, 2021, 25pp.

* cited by examiner

APPLICATOR WITH GAS-LIQUID EXCHANGING SECTION AND OCCLUDING BODY

RELATED APPLICATIONS

The present application is a continuation of International Application Number PCT/JP2018/031278, filed Aug. 24, 2018, which claims priority from Japanese Application Number 2017-197423, filed Oct. 11, 2017, and Japanese Application Number 2018-074715, filed Apr. 9, 2018 the disclosures of which applications are hereby incorporated by reference herein in their entirety.

TECHNICAL FIELD

The present invention relates to an applicator applied to a writing tool such as a felt-tip pen and a marking pen, a cosmetic tool such as an eyeliner, a stamp, a medication application container and the like. The applicator is configured to allow storage and application of various kinds of liquid such as ink, skin lotion, perfume, and medicine.

BACKGROUND ART

There has been a known applicator configured to store the liquid such as the ink and the skin lotion while being kept intact for application at any time instead of being kept occluded in an occluding body such as an inner cotton. For example, the direct liquid type applicator (writing tool) is disclosed in patent Document 1. The disclosed writing tool has a through hole formed in the partition wall for partitioning between the reservoir chamber and the ink storage chamber so that the relay core penetrates the partition wall while being inserted into the through hole. The predetermined gap is formed between the inner wall of the through hole and the relay core so that the ink is held under capillary force and the writing tool is configured that the gas-liquid exchange is caused in this gap.

The ink stored in the ink storage chamber is subjected to the gas-liquid exchange at the gap between the inner wall of the through hole and the relay core (so that air can inflow to the inside of the ink storage chamber), and thereby the ink is consumed (for writing) at the application body side. In this case, as the ink is consumed, air will enter into the ink storage chamber via the gap by the amount equivalent to the ink consumption amount. When the internal pressure of the ink storage chamber is raised owing to the temperature change and the like, the ink is likely to be pushed out to the inside of the reservoir chamber via the through hole. Especially in the case of temperature rise, the air expansion amount is reflected directly in the pushed-out amount of the ink. Accordingly, the ink is likely to be pushed out to cause outflow of a large quantity of the ink to the reservoir chamber, or to bring the application body side into the ink-rich state. As a result, there may cause a large dot stained (ink leakage) while wiring. The patent document discloses that the fibrous occluding body for temporarily holding the pushed-out ink is disposed in the reservoir chamber.

CITATION LIST

Patent Document

Patent Document 1: WO2004/000575

SUMMARY OF THE INVENTION

Problem to be Solved by the Invention

In the above-described direct liquid type writing tool, as the internal pressure of the storage chamber for storing the ink rises, the ink flows into the reservoir chamber side through the gas-liquid exchanging section. Since the flowing ink is held in the occluding body, the application body may be prevented from being in the ink-rich state (the dot-like ink is discharged from the application body). The occluding body in the reservoir chamber has the relay core penetrating therethrough while having the outer circumference in contact with the occluding body over a range of 360°. The material for forming the occluding body has the capillary force lower than that of the relay core. It is therefore possible to return the ink held in the occluding body to the relay core such that the ink is reused at the application body side.

In the case of using the writing tool less frequently over a long time, the occluding body may be saturated before using up the ink in the storage chamber. When the occluding body is saturated with the ink, the excessive ink may move toward the application body while running along the relay core that penetrates through the occluding body with no space, thus bringing the application body into the ink-rich state. When the application body is in the ink-rich state, the ink may be stained in the large dot while writing, or the ink leakage may occur.

An object of the present invention is to provide an applicator having an occluding body in the reservoir chamber for occluding the liquid flowing from the storage chamber. The applicator is configured to prevent the application body from being brought into the liquid-rich state by keeping the liquid from returning to the relay member from the saturated occluding body.

Means for Solving Problem

In order to achieve the above-described object, the applicator according to the present invention includes a main body, a storage chamber disposed in the main body for storing a liquid, a reservoir chamber disposed in the main body to allow the liquid flowing from the storage chamber to be held, a partition wall for partitioning between the storage chamber and the reservoir chamber, an application body disposed at an end of the main body to allow application of the liquid stored in the storage chamber, a relay member that transfers the liquid stored in the storage chamber passing through the partition wall toward the application body, a gas-liquid exchanging section formed at the partition wall for performing gas-liquid exchanging with the liquid stored in the storage chamber, an occluding body that is disposed in the reservoir chamber, and in contact with the relay member for occluding the liquid, and a movement prevention section disposed at the relay member and/or the occluding body to prevent movement of the liquid held in the occluding body to the relay member.

The above-structured applicator has the partition wall for partitioning between the storage chamber for storing the liquid, and the reservoir chamber capable of holding the liquid flowing from the storage chamber. The liquid stored in the storage chamber is transferred toward the application body via the relay member that passes through the partition wall. The occluding body for occluding the liquid is disposed in the reservoir chamber while being in contact with the relay member. If the quantity of the liquid flowing from the storage chamber side becomes larger than necessary, the excessive liquid is occluded. In this case, even if the occluding body is saturated before using up the liquid in the storage chamber, the outflow of the excessive liquid to the relay member may be suppressed by the movement prevention section disposed in the relay member and/or the occluding body for preventing movement of the liquid held in the occluding body to the relay member. The application body side is prevented from being in the liquid-rich state. The occluding body is provided with the movement prevention section to prevent movement of the occluded liquid to the relay member side. Therefore, it is possible to prevent the application body side from being in the liquid-rich state.

In order to achieve the above-described object, the applicator according to the present invention includes a main body, a storage chamber disposed in the main body for storing a liquid, a reservoir chamber disposed in the main body to allow the liquid flowing from the storage chamber to be held, a partition wall for partitioning between the storage chamber and the reservoir chamber, an application body disposed at an end of the main body to allow application of the liquid stored in the storage chamber, a relay member that transfers the liquid stored in the storage chamber passing through the partition wall toward the application body, a gas-liquid exchanging section formed at the partition wall for performing gas-liquid exchanging with the liquid stored in the storage chamber, a first occluding body that is disposed in the reservoir chamber, and has at least a part in contact with the relay member for holding the liquid, and a second occluding body that is in contact with the first occluding body to allow transfer of the liquid from the first occluding body, and in noncontact with the relay member.

The above-structured applicator is configured to transfer the liquid stored in the storage chamber toward the application body via the relay member passing through the partition wall. In the reservoir chamber, the first occluding body for holding the liquid is disposed while being at least partially in contact with the relay member. The first occluding body is in contact with the second occluding body that is in noncontact with the relay member. The first occluding body holds the liquid flowing from the storage chamber side, and transfers the liquid that has been held to the second occluding body. Even if the second occluding body is saturated before using up the liquid in the storage chamber, the second occluding body in noncontact with the relay member suppresses the outflow of the excessive liquid to the relay member. This may prevent the application body side from being in the liquid-rich state. As the second occluding body is in noncontact with the relay member, the occluded liquid does not move to the relay member side. This may prevent the application body side from being in the liquid-rich state.

Effect of the Invention

The present invention provides the applicator having an occluding body in the reservoir chamber for occluding the liquid flowing from the storage chamber. When the occluding body is saturated, the applicator may prevent the application body from being in the liquid-rich state by keeping the liquid from returning to the relay member.

BRIEF DESCRIPTION OF DRAWINGS

FIG. 12A is a longitudinal sectional view, and FIG. 12B is a sectional view taken along line A-A of FIG. 12A.

MODE(S) FOR CARRYING OUT THE INVENTION

Figure 1:
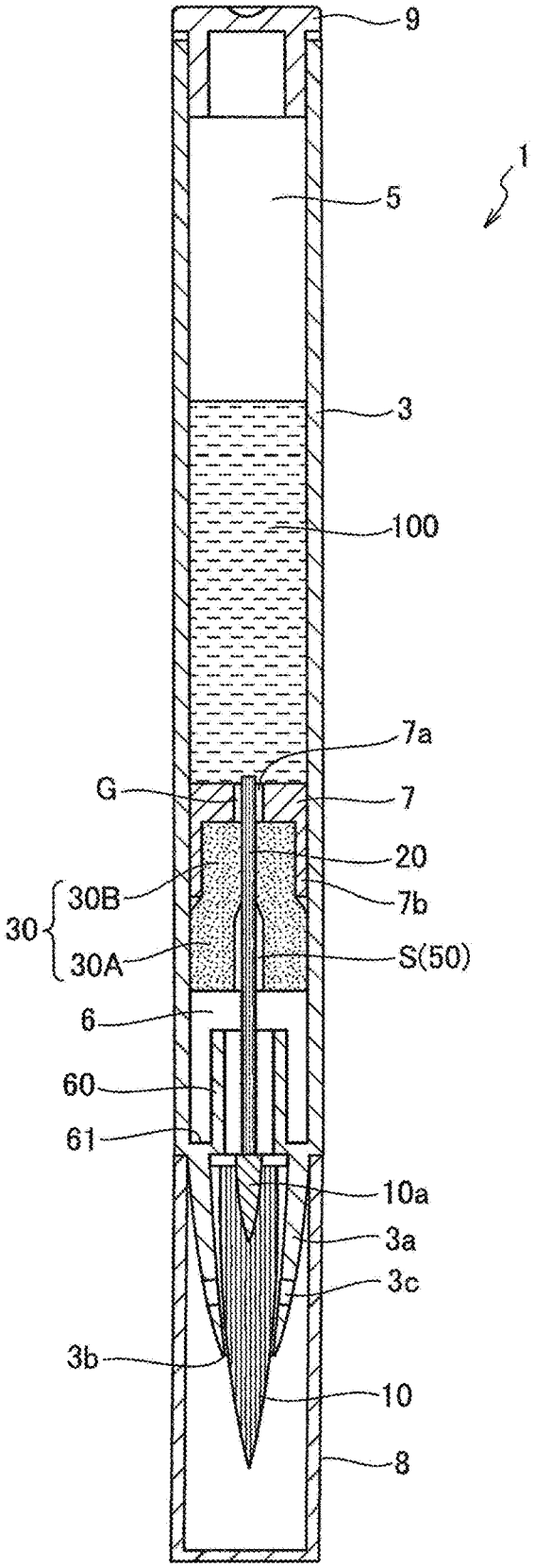
FIG. 1 is a longitudinal sectional view of a first embodiment of an applicator according to the present invention.

Embodiments of an applicator according to the present invention will be described referring to the drawings. The applicator to be described in the following embodiments is formed as a cosmetic article applied to the eyeliner.

FIG. 1 is a longitudinal sectional view of an applicator as a first embodiment.

An applicator 1 of the embodiment includes a cylindrical shaft (main body) 3 having a cavity. In the main body 3, a storage chamber 5 for storing a liquid 100, and a reservoir chamber 6 capable of holding the liquid 100 flowing from the storage chamber 5 are disposed. The storage chamber 5 and the reservoir chamber 6 are partitioned by a partition wall 7. A cap 8 for protecting an application body to be described later is detachably press-fitted to a holder section 3*a* of the main body 3 at its leading end side. A cap-like tail plug 9 is attached to a rear end side.

The main body 3 may be formed to have a circular cross section, or a non-circular (polygonal and the like) cross section. The tail plug 9 may be press-fitted or fixed to the main body 3. The tail plug may be detachable, from where the liquid is filled into the main body 3, and sealed. The tail plug 9 may be omitted so long as the liquid is filled from the leading end side.

The holder section 3*a* that has a diameter gradually reduced toward an end, and an opening 3*b* at the end, is formed at the end of the main body 3. An application body (brush) 10 is fitted to the holder section. A fibrous holding body 10*a* for holding the liquid to be transferred via a relay member to be described later is disposed inside the application body 10 so that the application body 10 is soaked with the liquid filled in the holding body 10*a*. The holder section 3*a* has an atmosphere communication hole 3*c* communicated with outside air. The atmosphere communication hole 3*c* is communicated with the reservoir chamber 6 via the inner side of the holder section 3*a*.

The holder section 3*a* may be integrated with the main body 3. Alternatively, the holder section 3*a* may be formed separately from the main body 3, and integrated with the main body 3 while holding the application body 10. The opening 3*b* may be used for communication with the outside air.

A through hole 7*a* is formed in the center of the partition wall 7. A long and thin relay member 20 with a circular cross section is inserted into the through hole 7*a*. The relay member 20 according to the embodiment is inserted so that a gap G is formed between an inner surface of the through hole 7*a* and an outer surface of the relay member 20. The relay member has its leading end side connected to the application body 10 (holding body 10*a*), and its rear end side protruding to the inside of the storage chamber 5.

The gap G is formed to allow the capillary force to hold the liquid. A gas-liquid exchanging section is formed between the gap G and the storage chamber 5 in which the liquid is stored. When the liquid is consumed at the side of the application body 10, the liquid held in the gap G will move to the relay member 20. When the liquid in the gap G is consumed, air flows into the storage chamber 5 so that the gap G is filled with the liquid again. Upon consumption of the liquid at the application body side, the gap G performs the function (gas-liquid exchange function) that allows air to flow into the storage chamber 5 by the amount equivalent to that of the consumed liquid.

In this case, depending on the viscosity level of the liquid, the gap G may be formed between the outer surface of the relay member 20 and the inner surface of the through hole 7*a* so long as the capillary force is capable of holding the liquid. The gap G may be configured for the gas-liquid exchange while abutting on the relay member 20 at two or more points by, for example, inserting the relay member with the circular cross section into the through hole 7*a* with polygonal or elliptical cross section (non-circular cross section). This structure allows easy positioning of the relay member 20. Alternatively, the relay member 20 may be inserted into the circular through hole to form one or more slits in the outer surface of the relay member 20 along the axial direction, one or more slits may be formed on an edge portion of the through hole to radially extend, and one or more protrusions may be formed on the inner surface of the through hole while abutting on the outer surface of the relay member 20.

The gas-liquid exchanging section may be formed in an arbitrary part of the partition wall 7. For example, the through hole may be formed in the part except the part where the relay member 20 is fitted to the partition wall 7 with no gap to allow air to move toward the storage chamber 5. It is also possible to form a gap between an outer circumferential edge of the partition wall 7 and the inner surface of the main body 3 (third embodiment). That is, the structure of the gas-liquid exchanging section may be appropriately modified so long as the liquid is transferred to the application body side via the relay member 20 by the amount corresponding to quantity of air expanded as a result of entry from the reservoir chamber to the storage chamber side.

The relay member 20 is formed by compressing a bundle of many fibers axially parallel with one another into a porous rod-like member. The liquid is transferred toward the application body 10 (holding body 10*a*) side while running along the outer surface of the relay member under the inner capillary force. In this case, the relay member 20 may have any structure so long as the liquid stored in the storage chamber 5 is transferred toward the application body under the capillary force with high sensitivity. The porosity of the relay member will be appropriately selected in accordance with viscosity of the liquid stored in the storage chamber. For example, it is preferable to use the relay member with low porosity for the low viscosity liquid, and the relay member with high porosity for the high viscosity liquid.

The relay member 20 may be made of arbitrary material without being limited to the fibrous material so long as it has the function for transferring the liquid stored in the storage chamber toward the application body 10. For example, a molded product such as plastic may be used to hold the liquid along the axial direction under the capillary force.

The holding body 10*a* disposed inside the application body 10 may be integrally formed with the relay member 20. Alternatively, the holding body 10*a* may be formed by compressing a bundle of a plurality of fibers likewise the relay member, and brought into abutment on the end surface of the relay member. That is, the holding body itself causes a capillary action among the respective fibers to perform the function of transferring the liquid longitudinally and soaking the application body 10 with the liquid. The capillary force of the holding body 10*a* may be set to be higher than that of the relay member 20 so that the liquid is easily movable to the application body 10. However, each capillary force of the holding body 10*a* and the relay member 20 may be set to the same value.

As the drawing shows, in the reservoir chamber 6, an occluding body 30 is disposed to enclose the relay member 20 while being in contact with the outer circumference of the relay member so that the liquid is occludable. The occluding body 30 may be constituted by the porous material (cotton), for example, fibrous material. Even if a large quantity of liquid flows into the relay member 20, the above-structured occluding body 30 disposed in the reservoir chamber 6 holds the inflowing liquid to prevent the application body 10 from being in the liquid-rich state, and to allow the absorbed liquid to return to the relay member 20 (reuse by application). The occluding body 30 may have any structure so long as the liquid storable function is secured. Besides the porous material as described above, the occluding body may be constructed as a bellows-like member (molded article such as plastic) that allows the liquid to be successively held along the axial direction under the capillary force.

The occluding body 30 may be constituted by a single member (porosity is set to be uniform). However, the occluding body 30 of the embodiment is formed to have the porosity variable in the axial direction. In this case, a code 30A refers to a high porosity region (region with low capillary force), and a code 30B refers to a low porosity region (region with high capillary force).

As the drawing shows, the partition wall 7 has an annularly protruding holder 7*b* toward the reservoir chamber. The holder 7*b* has the inner diameter smaller than an outer diameter of the occluding body, and the axial length shorter than that of the occluding body. This makes it possible to easily form the occluding body as the single part having the porosity variable in the axial direction. That is, the occluding body 30 that is axially longer than the holder 7*b* provides the occluding structure having a low porosity section at the side of the partition wall 7, and a high porosity section at the side of the application body 10.

Upon mass production of the occluding body 30 constituted by the porous material, it is difficult to make the porosity uniform by compressing the occluding body. Normally, the porosity of the occluding body before assembly (occluding body in production) is set to be higher than that of the relay member 20 (capillary force of relay member-≥capillary force of occluding body). Actually, an error of approximately +/−15% occurs with respect to the designed porosity. As described above, on the assumption that the occluding body is constituted by the single member, if the porosity is higher than the designed value, the occluding body may no longer absorb the liquid flowing from the relay member 20 because of the large error in the porosity of the occluding body. Accordingly, the application body is likely to be in the liquid-rich state. Meanwhile, if the porosity is lower than the designed value, the liquid suction force may become too strong to supply the liquid sufficiently to the application body side.

As the drawing shows, the holder 7*b* with the diameter smaller than that of the occluding body is integrally formed with the partition wall 7 so that the occluding body 30 is partially fitted to the holder. Accordingly, the occluding body is held so that the porosity varies along the axial direction (the region 30A with low capillary force and the region 30B with high capillary force). In spite of unevenness in the porosity of the occluding body in manufacturing, the occluding body may serve to securely occlude the excessive liquid. The excessive liquid is securely held in the region 30B with high capillary force. If the region 30B with high capillary force is saturated with the liquid, the liquid may be held in the region 30A with low capillary force. This makes it possible to increase the liquid storage.

Normally, the capillary force of the relay member 20 is set to be higher than each capillary force of the occluding bodies 30A, 30B. When the liquid in the relay member 20 is brought into the liquid-poor state owing to continuous application at the application body side, the liquid held in the occluding bodies 30A, 30B is allowed to flow to the relay member side and to be reused. In this case, the liquid to be reused in the relay member 20 returns thereto at the side of the occluding body 30B with high capillary force, as follows.

Concerning the relation between the relay member 20 and the occluding body 30, a movement prevention section 50 is formed around the relay member 20 and/or the occluding body 30 for preventing the liquid held in the occluding body from moving to the relay member 20.

The movement prevention section 50 of the embodiment is formed as a gap S (gap formed over a range of 360°) along the axial direction between the occluding body 30A with high porosity (low capillary force) and the outer surface of the relay member 20. The gap S may be formed in the occluding body 30A as a through hole with diameter larger than that of the relay member 20. The gap S may prevent the liquid from returning to the relay member 20 from the occluding body section (occluding body 30A) where the gap S exists.

It is preferable to form the above-described movement prevention section 50 at the application body side to cope with the possible circumstance as described below. That is, if the movement prevention section is formed at the partition wall side, and the relay member is in contact with the occluding body at the application body side, the water load is generated upon application to make the liquid to be likely to easily return to the relay member 20. That is, the movement prevention section 50 formed at the application body side secures to prevent movement of the liquid to the relay member 20 even if the water load acts on the occluding body 30A in application or the like.

In the reservoir chamber 6, it is preferable to form an annular liquid outflow prevention wall 60 that has a bottom section 61 between the liquid outflow prevention wall 60 and the main body 3, and encloses the relay member 20. The liquid outflow prevention wall 60 is disposed between the occluding body 30 and the application body 10. When the above-described occluding body 30A at the application body side is saturated, and no longer holds the liquid, the liquid outflow prevention wall 60 serves to store the liquid that cannot be held. It is preferable to allow the application body side of the occluding body 30 (side of the occluding body 30A) to be in contact with the inner surface of the main body 3 as shown in the drawing. Normally, as the liquid has a property of running along the contact part, the contact state of the occluding body 30A with the inner surface of the main body secures to guide the excessive liquid to the bottom section 61. The liquid outflow prevention wall 60 is capable of securely preventing transfer of the liquid to the relay member 20 (preventing the application body side from being in the liquid-rich state).

Functions of the above-described applicator will be explained.

As described above, the occluding body 30 disposed in the reservoir chamber 6 allows storage of the liquid that has been pushed out from the storage chamber side at increasing temperature. This may prevent the application body side from being in the liquid-rich state. In this case, the occluding body 30 is configured to have the occluding body 30B with high capillary force at the partition wall side, and the occluding body 30A with low capillary force at the application body side using the holder 7*b* of the partition wall. Accordingly, the liquid flowing from the storage chamber is occluded in the occluding body 30B first. When the occluding body 30B is saturated, the liquid may be occluded in the occluding body 30A side. As the above-described applicator is used for a long time (used less frequently), the occluding body 30B is saturated before using up the liquid in the storage chamber, and the occluding body 30A may be saturated. Even if both the occluding bodies 30A and 30B are saturated with the liquid, the movement prevention section 50 (gap S) for preventing movement of the liquid held in the occluding body to the relay member is formed between the relay member 20 and the occluding body 30A. This makes it possible to suppress outflow of the excessive liquid to the relay member 20, and to prevent the side of the application body 10 from being in the liquid rich state.

In the embodiment, the movement prevention section 50 disposed at the application body side in the occluding body 30 may securely prevent the liquid in the saturated state from returning to the relay member 20 under the water load. Even if the occluding bodies 30A, 30B are saturated, and the liquid further enters into the occluding body from the storage chamber side, the liquid may be stored with the liquid outflow prevention wall 60 having the bottom section 61 between the liquid outflow prevention wall and the main body 3. Therefore, it is possible to securely prevent the liquid returning to the relay member 20 from bringing the application body side into the liquid-rich state. By considering the quantity of the liquid that can be held in the occluding bodies 30A and 30B, and the quantity of the liquid stored in the storage chamber 5, it is possible to set so that the liquid at the occluding body side may be kept from being excessive. For example, as the liquid by the quantity smaller than that of the liquid that can be held in the occluding bodies 30A and 30B is stored in the storage chamber, the occluding bodies 30A and 30B are hardly saturated. As the movement prevention section 50 (gap S) prevents the liquid held in the occluding body 30A from being in contact with the relay member 20, even if the occluding body 30B is saturated with the liquid, the liquid held in the occluding body does not move to the relay member 20. This may prevent the application body side from being in the rich state.

In the above-described structure, The relation between the capillary force of the gap G (gas-liquid exchanging section) and the capillary force of the occluding body 30 (particularly, the occluding body 30B at the partition wall side) may be established as described below.

As the capillary force of the gas-liquid exchanging section G is set to be higher than that of the occluding body 30B, movement of the liquid to the occluding body 30B, and further to the occluding body 30A may be limited at a normal temperature.

As the capillary force of the gas-liquid exchanging section G is set to be equal to or lower than that of the occluding body 30B, the liquid becomes likely to move to the occluding body 30B at the normal temperature. This makes it possible to use the occluding body 30B as a liquid reservoir. In this case, if the liquid outflow is managed only by the occluding body 30B, the capillary force of the occluding body 30B needs to be set higher.

In the above-described structure, the capillary force of the occluding body 30 at the partition wall side is set to be higher (capillary force of occluding body 30B>capillary force of occluding body 30A). However, it is possible to set the capillary force uniform for the entire occluding body. Alternatively, the capillary force of the occluding body 30A at the application body side may be set to be higher than that of the occluding body 30B at the partition wall side. In the above-described structure, the liquid flowing from the occluding body 30B is held in the occluding body 30A with higher capillary force. As the liquid is unlikely to return to the occluding body 30B, the liquid occluded in the occluding body 30A may be securely prevented from returning to the relay member 20.

Another embodiment of the present invention will be explained.

In the embodiment, the similar components to those described in the first embodiment will be marked with the same reference codes, and detailed explanations thereof, thus will be omitted.

Figure 2:
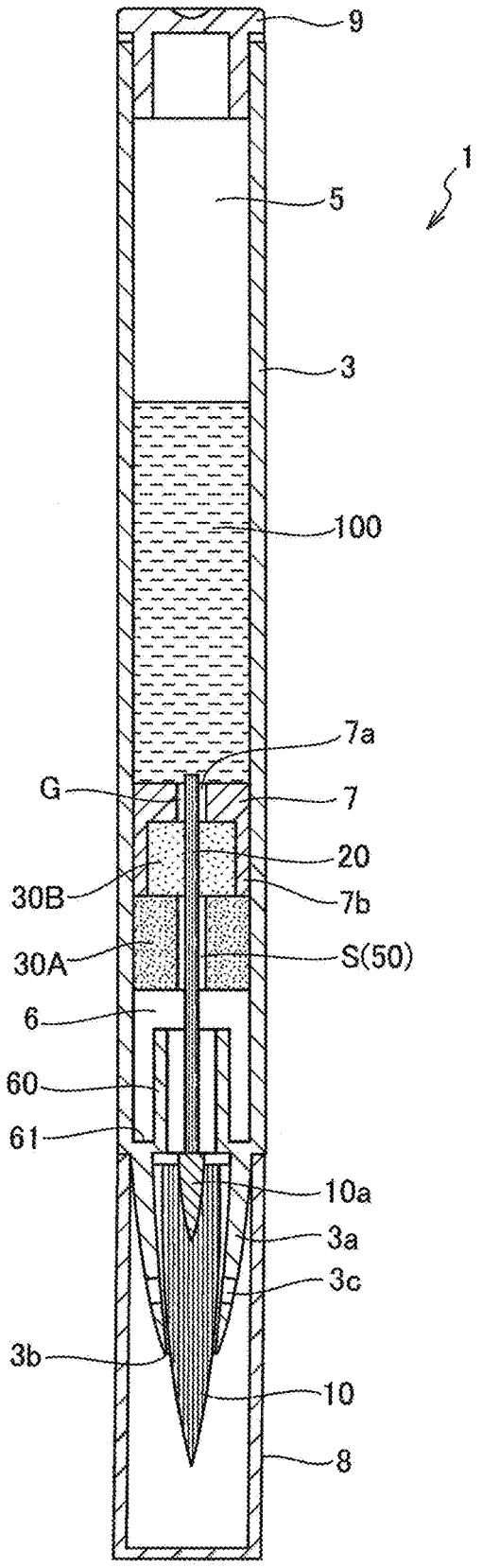
FIG. 2 is a longitudinal sectional view of a second embodiment of an applicator according to the present invention.

FIG. 2 is a view showing a second embodiment of the applicator.

In the embodiment as shown in FIG. 1, the occluding body 30 is constituted by the single member, and has the porosity in the axial direction variable (variable capillary force) by the holder 7*b* of the partition wall 7. As this embodiment shows, the occluding body may be constituted by two parts. Specifically, the occluding body 30B with high capillary force is disposed in the holder 7*b* at the side of the partition wall 7, and the occluding body 30A with low capillary force is disposed at the application body side. The above-described structure may provide the similar effect to the one derived from the structure shown in FIG. 1.

Figure 3:
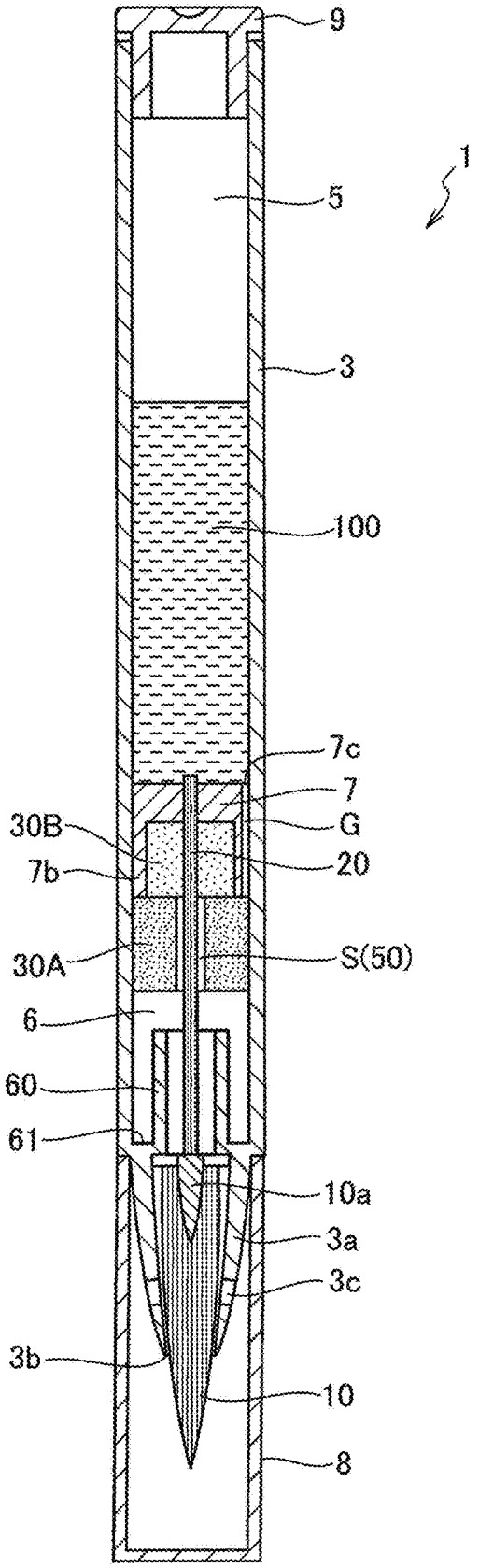
FIG. 3 is a longitudinal sectional view of a third embodiment of an applicator according to the present invention.

FIG. 3 is a view showing a third embodiment of the applicator.

In the embodiments shown in FIGS. 1 and 2, the gas-liquid exchanging section is formed as the gap G between the inner surface of the through hole 7*a* of the partition wall 7 and the outer surface of the relay member 20 to be inserted into the through hole 7*a*. The position where the gas-liquid exchanging section is disposed is not specifically limited. Likewise this embodiment, a slit 7*c* may be formed around a circumferential edge of the partition wall 7 so that the gap G is formed by the slit 7*c* between the partition wall and the inner surface of the main body 3, as the gas-liquid exchanging section. It is possible to fit the relay member 20 to the partition wall 7 with no gap.

In this embodiment, as the gas-liquid exchanging section G is communicated with the occluding body 30A with high porosity (low capillary force), the liquid flowing from the storage chamber 5 is held in the occluding body 30A first. The movement prevention section 50 serves to prevent supply of the occluded liquid to the relay member 20. That is, it is possible to prevent the liquid flowing from the storage chamber 5 via the gap G from returning directly to the relay member 20.

Figure 4:
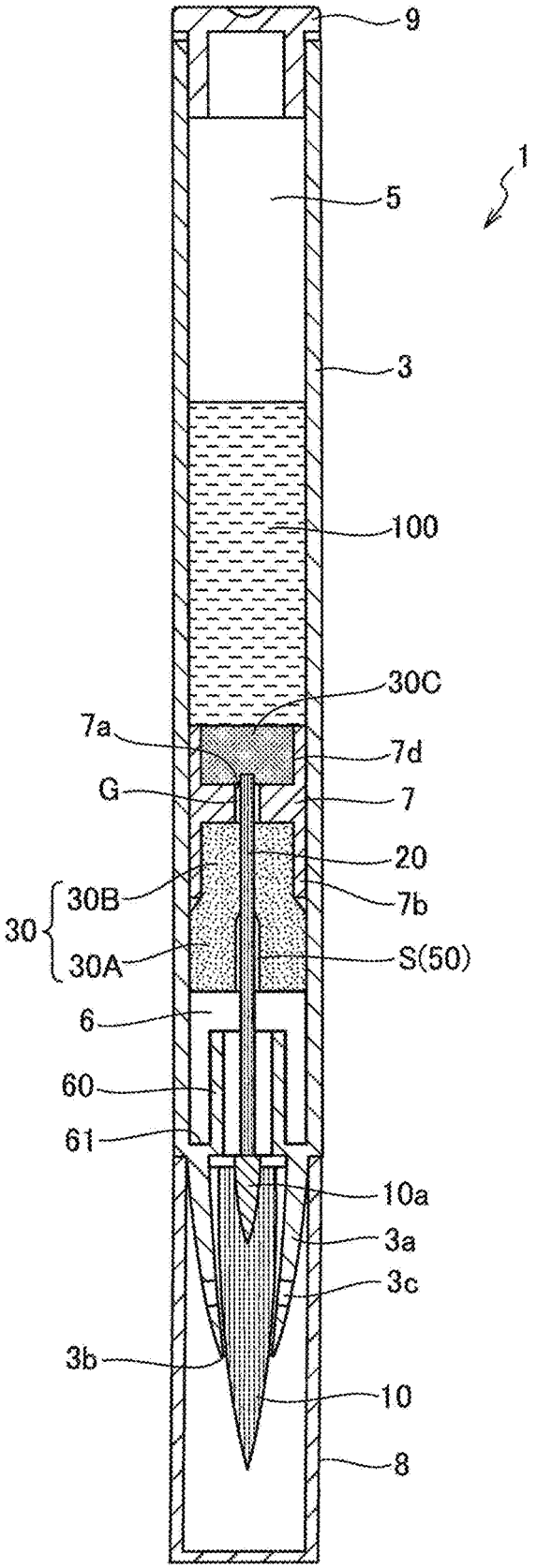
FIG. 4 is a longitudinal sectional view of a fourth embodiment of an applicator according to the present invention.

FIG. 4 is a view showing a fourth embodiment of the applicator.

Referring to the applicator shown in FIG. 1, in the embodiment, the partition wall 7 has a holder 7*d* at the storage chamber side to hold an occluding body (occluding body in the storage chamber) 30C constituted by the porous material. An inner part of the occluding body 30C comes in contact with the rear end of the relay member 20. Likewise the first embodiment, the gas-liquid exchange is configured to occurs in the gap G of the through hole 7*a* into which the relay member 20 is inserted. In this case, the capillary force of the occluding body 30C is set to be equal to or lower than that of the gap G constituting the gas-liquid exchanging section.

In the embodiment as shown in FIG. 1, the occluding bodies 30B, 30A may be saturated with the liquid in an early stage. In this embodiment, the occluding body 30C is disposed in the storage chamber so that the liquid is supplied toward the relay core side via the occluding body 30C that has been saturated first. The occluding bodies 30B, 30A are hardly saturated in the early stage to allow stable application for a prolonged time. If the gas-liquid exchanging section G is formed as the gap with the polygonal cross section (the gas-liquid exchanging section constituted by a plurality of gaps), the liquid is not held in all the gaps to possibly cause a siphonic phenomenon. Meanwhile, the occluding body 30C to be saturated with the liquid allows the liquid to be held in all the gaps under the capillary force, leading to the stable gas-liquid exchanging function.

Figure 5:
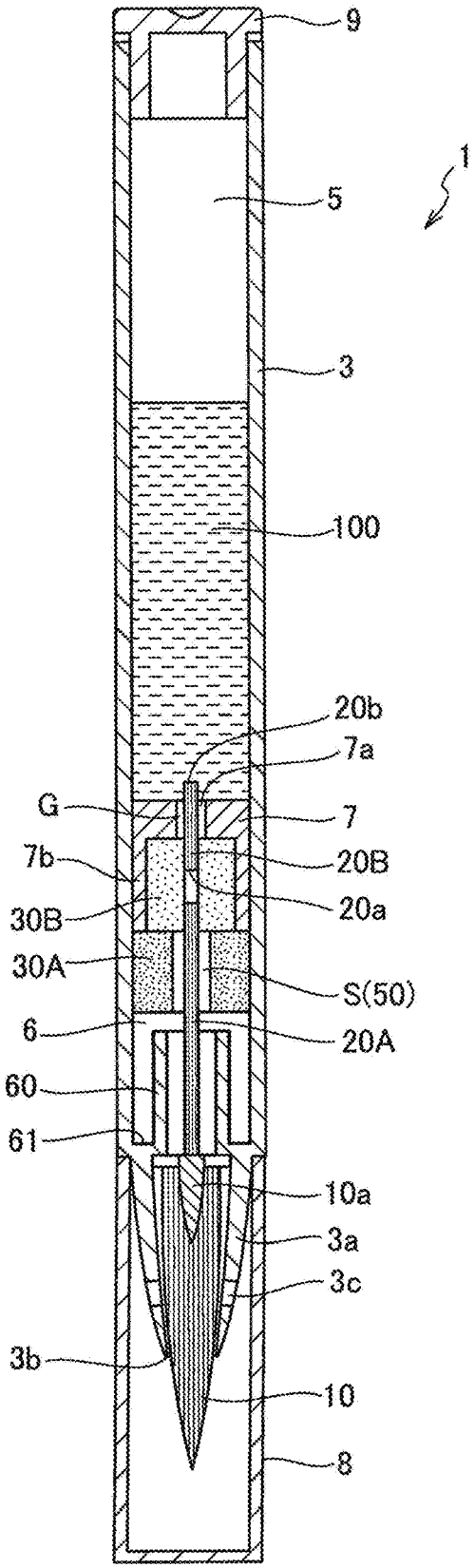
FIG. 5 is a longitudinal sectional view of a fifth embodiment of an applicator according to the present invention.

FIG. 5 is a view showing a fifth embodiment of the applicator.

Referring to the applicator as shown in FIG. 2, in this embodiment, the relay member 20 is separated in the axial direction into coaxial relay members 20A, 20B in the occluding body 30B with high capillary force. As the relay member 20 is separated in the occluding body section where the movement prevention section 50 as described above is not disposed, it is possible to prevent inflow of a large quantity of the liquid to the relay member. Specifically, in the applicator that stores the low viscosity liquid, the liquid is likely to flow to the relay member 20 so that the application body side is likely to be in the liquid-rich state. As the relay member is separated in the occluding body 30B, the occluding body 30B serves as the liquid reservoir so that the liquid therein is supplied from the part in contact with the relay member 20A to the application body side. In this case, if the liquid in the occluding body 30B is saturated, the excessive liquid flows to the occluding body 30A. The movement prevention section 50 then serves to prevent the liquid from returning to the relay member 20.

The above-described structure is capable of effectively limit the quantity of the liquid to be supplied to the application body 10. It is possible to further limit the liquid inflow quantity to the relay member 20B by closing an end surface 20*a* and/or an end surface 20*b* of the relay member 20B through the baking process or the like.

Figure 6:
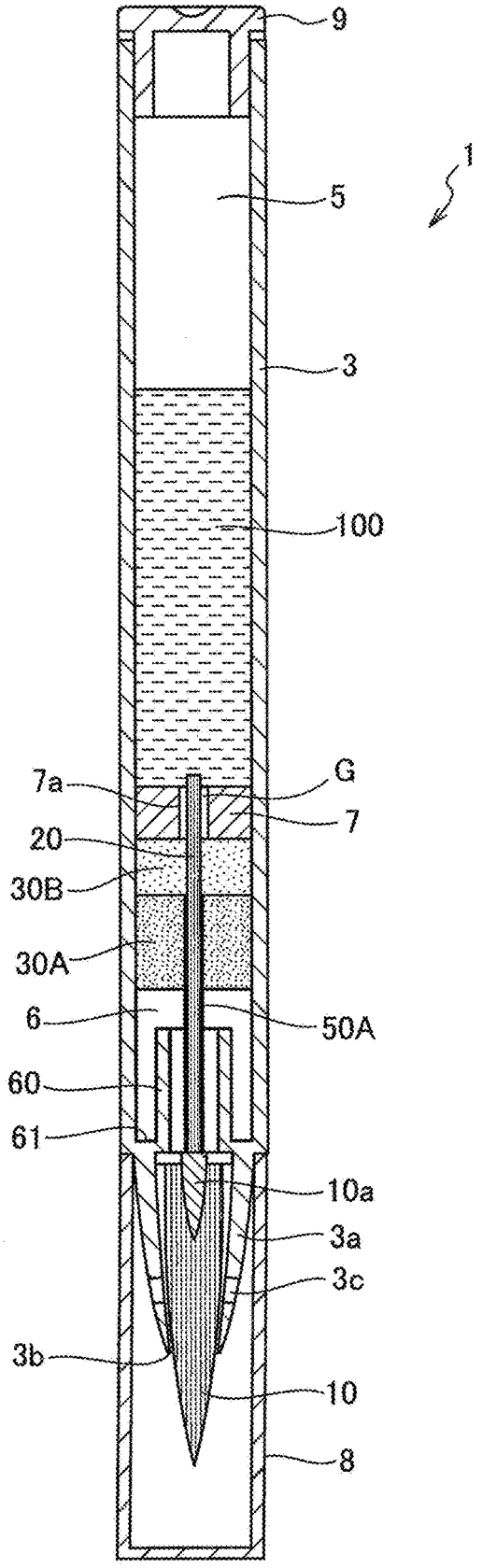
FIG. 6 is a longitudinal sectional view of a sixth embodiment of an applicator according to the present invention.

FIG. 6 is a view showing a sixth embodiment of the applicator.

In the embodiment, as indicated by FIG. 1 and the like, the movement prevention section 50 is formed as the gap (gap formed over a range of 360°) S along the axial direction between the occluding body 30A and the outer surface of the relay member 20. The structure of the movement prevention section is not specifically limited so long as the liquid from the occluding body section is prevented from returning to the relay member.

For example, it is possible to form the normal through hole in the occluding body so that the movement prevention section is disposed at the side of the relay member 20. Specifically, as the drawing shows, the movement prevention section may be formed as an outer skin 50A on the outer surface of the relay member 20 along the axial direction. The outer skin 50A may be formed by coating the outer surface of the relay member 20 with resin or wax, or applying the baking process to the surface. Alternatively, the outer skin may be formed by applying the baking process to the inner surface of the through hole of the occluding body 30A.

The movement prevention section may be formed in a predetermined axial range of the occluding body in consideration of the liquid storage or the like. The movement prevention section may be formed in at least a part of the region of the occluding body 30A with high porosity. The movement prevention section may be formed entirely over the occluding body 30A in the axial direction, and furthermore, formed in a part of the occluding body 30B. The occluding body may be constituted by the single member without varying the porosity in the axial direction. Furthermore, the movement prevention section may be formed only at the occluding body side, or only at the relay member side so long as the movement of the liquid from the occluding body to the relay member is prevented. Furthermore, the movement prevention section may be formed at both sides of the occluding body and the relay member.

Figure 7:
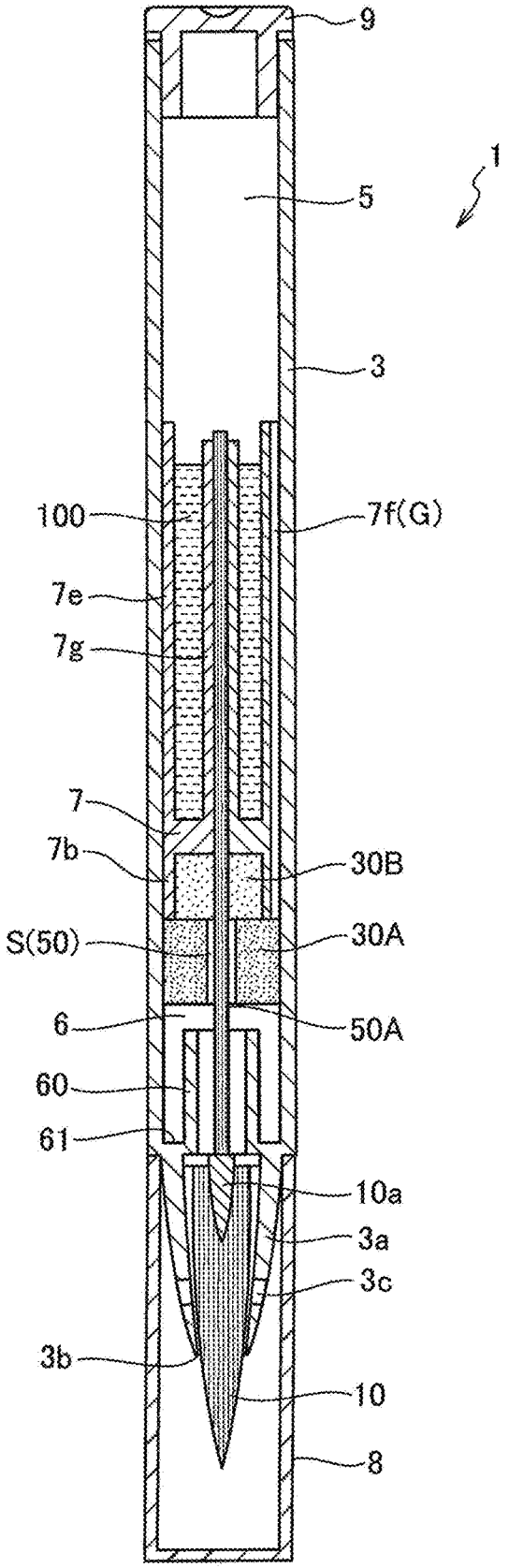
FIG. 7 is a longitudinal sectional view of a seventh embodiment of an applicator according to the present invention.

FIG. 7 is a view showing a seventh embodiment of the applicator.

Referring to the structure as shown in FIG. 3, in the embodiment, an annular side wall 7*e* extending toward the storage chamber side is formed on a circumferential end of the partition wall 7, and an axially extending groove (slit) 7*f* is formed in a part of an outer circumference of the side wall. The gap G between the slit and the inner surface of the main body is formed as the gas-liquid exchanging section. That is, the section of the partition wall 7 at the storage chamber side is formed to have a tumbler-like shape, and an extension 7*g* extending toward the storage chamber is formed in the section where the through hole 7*a* is formed. The relay member 20 is fitted to the inside of the extension 7*g* with no gap. The relay member 20 slightly protrudes from the end of the extension 7*g* to allow the liquid to be configured to inflow from the protruding portion. Furthermore, the gas-liquid exchanging section (gap G) is communicated with the occluding body 30A. The movement prevention section 50 is formed between the occluding body 30A and the relay member 20.

In the above-described structure, the storage of the liquid 100 is set to the level equal to or lower than the extension 7*g*. As the gas-liquid exchanging section G is in the state where the storage chamber 5 is regularly opened, the liquid in the storage section is likely to flow toward the application body side. That is, as the gas-liquid exchange occurs with no resistance against the liquid, the high viscosity liquid in storage may be smoothly supplied to the application body side. The high viscosity liquid is unlikely to flow into the gas-liquid exchanging section G even if the posture of the main body is changed sideways. In spite of the liquid inflow, the liquid may be occluded in the occluding body 30A without returning to the relay member 20. The application body side, thus, is hardly brought into the liquid-rich state.

In the case of the high viscosity liquid in storage, the above-described structure may have the gap between the extension 7*g* and the relay member 20 to allow the gas-liquid exchanging.

Figure 8:
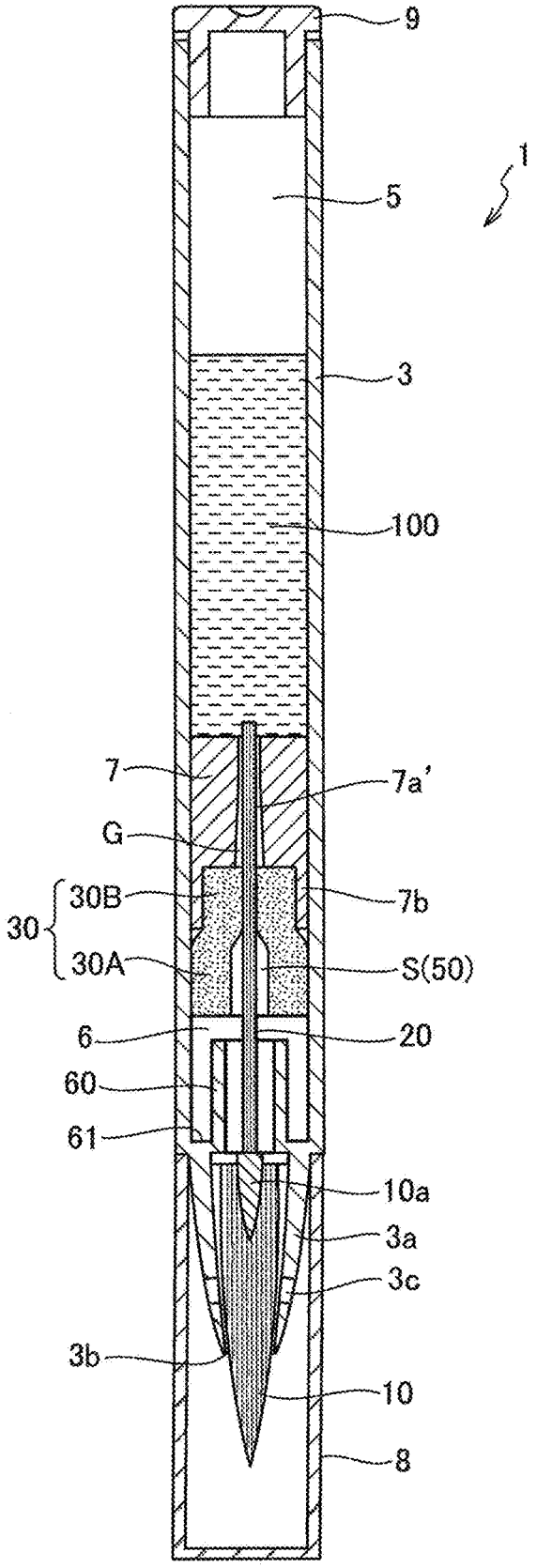
FIG. 8 is a longitudinal sectional view of an eighth embodiment of an applicator according to the present invention.

FIG. 8 is a view showing an eighth embodiment of the applicator.

Referring to the structure as shown in FIG. 1, in the embodiment, the partition wall 7 has its thickness increased in the axial direction, and has a tapered through hole 7*a*' having its diameter gradually increased toward the application body. The through hole 7*a*' having a function as the gas-liquid exchanging section is structured to hold the liquid under the capillary force generated between the through hole 7*a*' and the relay member 20 to be inserted therethrough. In the structure, the capillary force at the application body side is gradually lowered.

In the above-described structure, under the increasing internal pressure of the storage chamber 5, the liquid is held over the entire gap G. Accordingly, outflow of the liquid to the occluding body 30 may be limited to a certain degree. Under the lowering internal pressure at the storage chamber side, the capillary force of the gap G at the storage chamber side provides the suction back effect. This makes it possible to efficiently consume the liquid.

In the above-described structure, the through hole 7*a*' is tapered. The through hole may be formed of straight stepped type having the diameter at the application body side gradually increased, or a complex type with the tapered and stepped structure.

Figure 9:
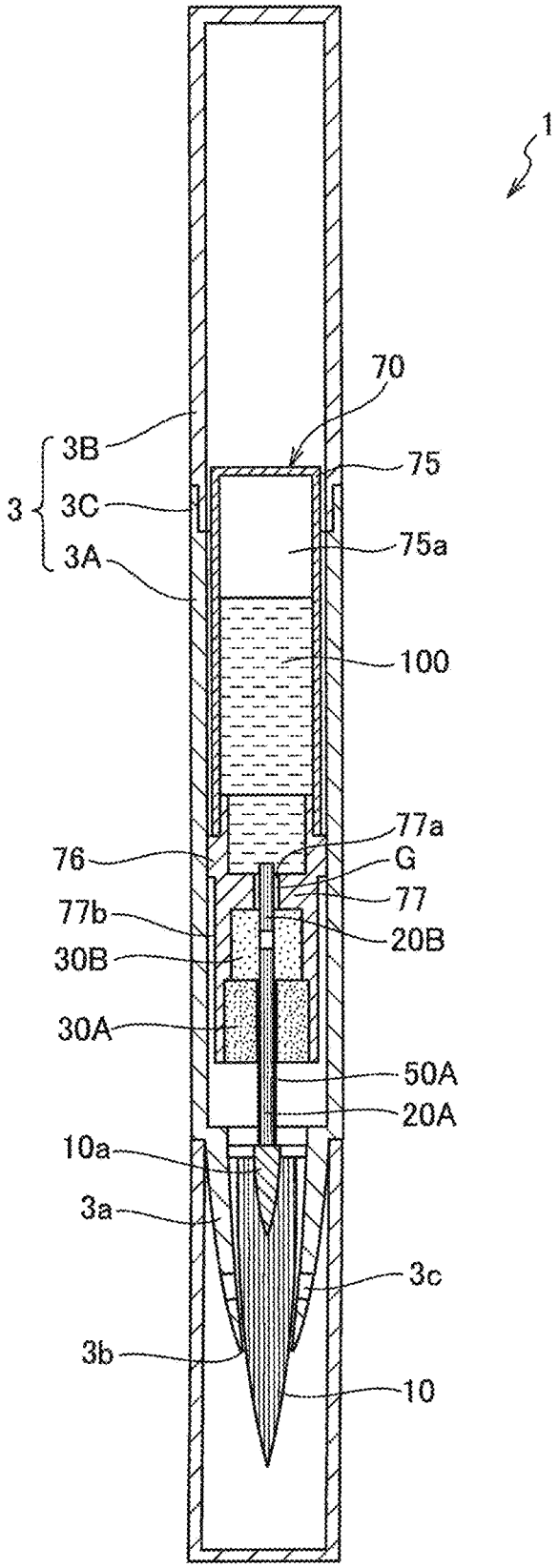
FIG. 9 is a longitudinal sectional view of a ninth embodiment of an applicator according to the present invention.

FIG. 9 is a view showing a ninth embodiment of the applicator.

In this embodiment, the section in which the liquid is stored is formed as a refill structure that is detachably fitted to the main body 3 of the applicator. Specifically, the main body 3 of the applicator includes an application body side main body 3A and a tail plug side main body 3B, which are separable at a press fit section 3C. The tail plug side main body 3B is separated from the application body side main body 3A so that a refill 70 with a storage section is detachably fitted to the application body side main body 3A.

The refill 70 includes a cylindrical portion 75 with a storage section 75*a* in which the liquid 100 is stored, and a main portion 76 integrated with the cylindrical portion 75 for holding the occluding bodies 30A, 30B each having the similar structure to that of the embodiment while having the relay member 20B disposed therein. In this case, the main portion 76 serves as the reservoir chamber in the above-described embodiment. The main portion 76 is integrally formed with a partition wall 77 having a through hole 77*a*. A holder 77*b* of the partition wall 77 holds the occluding bodies 30A, 30B which are similar to those described in the embodiment. In this case, the holder 77*b* at the side of the application body 10 has a large internal diameter. The porosity of the occluding body 30A held by the holder 77*b* is set to be higher than that of the occluding body 30B to be held at the partition wall side. Likewise the structure as shown in FIG. 5, the relay member is separated in the occluding body 30B. The relay member 20A at the application body side is formed as the component of the application body side main body 3A, not as the refill element.

The refill 70 includes such components as the storage section 75*a* (cylindrical portion 75) for storing the liquid, the main portion 76, the occluding bodies 30A, 30B, and the relay member 20B to be positioned coaxially with the relay member 20A when fitting the refill 70 to the application body side main body 3A. The through hole is formed in the occluding bodies 30A, 30B to allow the relay member 20A as the component of the application body side main body 3A to be fitted (the rear end of the relay member 20A is fitted to the through hole of the occluding body 30B at the application body side). The outer skin 50A is applied to the outer surface of the relay member 20A in the application body side main body 3A corresponding to the position at which the occluding body 30A is disposed so that the liquid held in the occluding body 30A is kept from returning to the relay member 20A.

As described above, the applicator according to the present invention may be formed as the refill structure in accordance with the usage and the liquid to be stored. The above-described structure allows easy positioning of the relay member 20B to the relay member 20A.

In the structure as shown in the drawing, the relay member may be constituted by the single member without being separated. In this case, the relay member may be formed as the component of the refill side, or formed as the component of the application body side main body 3A. Likewise the embodiment as described above, it is possible to provide the annular liquid outflow prevention wall that defines the bottom section with the application body side main body, and encloses the relay member.

Figure 10:
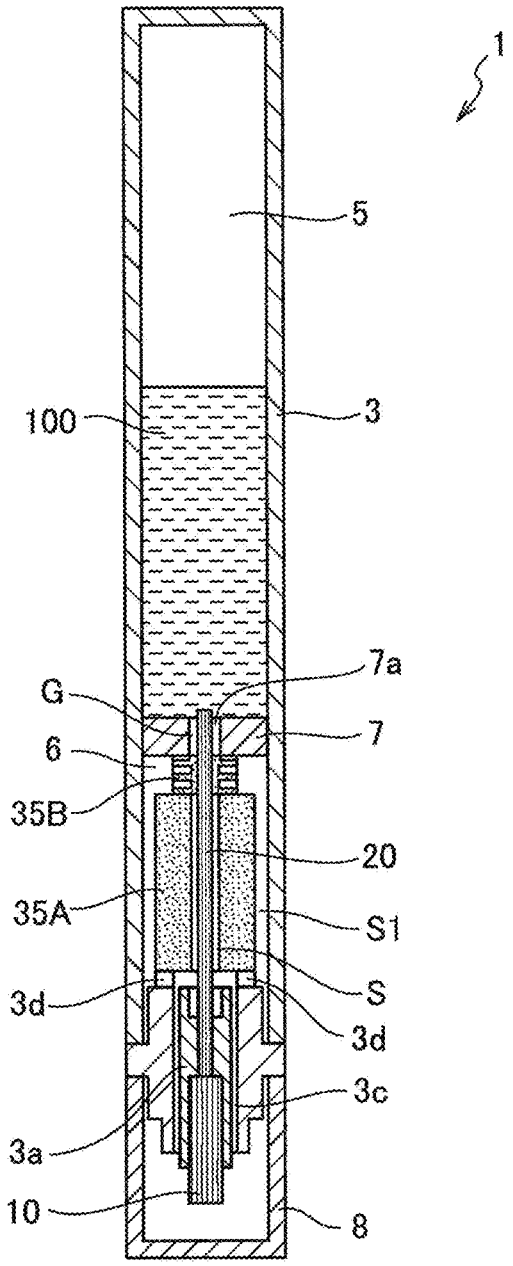
FIG. 10 is a longitudinal sectional view of a tenth embodiment of an applicator according to the present invention.

FIG. 10 is a view showing a tenth embodiment of the applicator.

As described above, the occluding body for holding the liquid flowing from the storage chamber side may be constituted by the single part as shown in FIG. 1 and the like, or by the two parts as shown in FIG. 2 and the like. When using the two parts for forming the occluding body, each of those parts may be made of the porous material incorporated with the fiber as shown in FIG. 2 and the like. The occluding body may be constituted by the porous material and the molded product as shown in FIG. 10 (both parts may be constituted by the molded products).

Specifically, the occluding body of the embodiment includes a first occluding body 35B that is disposed in the reservoir chamber 6 in contact with the relay member 20 for holding the liquid, and a second occluding body 35A that comes in contact with the first occluding body 35B to allow transfer of the liquid from the first occluding body 35B while being noncontact with the relay member 20.

The first occluding body 35B is constituted by the bellows-like member (molded product such as plastic) for sequentially holding the liquid along the axial direction under the capillary force. The second occluding body 35A is constituted by the porous material incorporated with fiber. In this case, the second occluding body 35A is in noncontact with the relay member 20 by the gap (gap formed over a range of 360°) S formed between the second occluding body 35A and the outer surface of the relay member 20 along the axial direction. The first occluding body 35B may have its entire surface in contact with the second occluding body 35A. The first occluding body 35B may also have its part (for example, an outer diameter portion) in contact with the second occluding body 35A.

Such a molded product (occluding body constituted by the bellows-like member) is generally employed for the writing tool such as a fountain pen. Compared with the known molded product, the molded product as described above has the smaller outer diameter and the shorter axial length, resulting in easy dimensional control. The molded product may be integrated with the partition wall 7 to constitute the first occluding body 35B. Integration of the partition wall 7 and the first occluding body 35B allows improvement in assemblability to the main body 3.

In the embodiment, the holder section 3*a* is formed separately from the main body 3, and integrally fixed thereto. An atmosphere communication hole 3*c* is formed along the axial direction in the holder section 3*a* at a part for holding the application body 10 radially outward. A rib 3*d* formed on the holder section 3*a* at the storage chamber side serves to hold the second occluding body 35A kept noncontact with the relay member 20. A gap S1 may intervene between the second occluding body 35A and the inner surface of the main body 3 for improving the gas-liquid exchanging sensitivity.

The first occluding body 35B intervening between the second occluding body 35A and the partition wall 7 serves to hold the liquid running along the relay member 20, and to hold the liquid flowing from the gas-liquid exchanging section (gap G formed between the outer surface of the relay member 20 and the inner surface of the through hole 7*a*). It is possible to provide the function and the effect similar to those derived from the occluding body 30 (30B) as described in the embodiments. As the first occluding body 35B in contact with the relay member 20 is the molded product, the additive such as preservatives contained in the liquid may be fully applied to the application body side without being remained like the case using the fibrous material. In the embodiment, it is possible to provide the liquid outflow prevention wall 60 in the reservoir chamber 6 likewise the embodiment as described above.

In the structure as described above, the capillary force of the first occluding body 35B is set to be higher than that of the second occluding body 35A, and the capillary force of the gas-liquid exchanging section G is set to be equal to or lower than that of the first occluding body 35B.

In the structure, the first occluding body 35B may be used as the liquid reservoir. The liquid overflown from the saturated first occluding body 35B may be transferred to the second occluding body 35A. It is therefore possible to delay the timing of saturating the second occluding body 35A with the liquid as much as possible.

Alternatively, in the structure as described above, the capillary force of the first occluding body 35B may be set to be lower than that of the second occluding body 35A, and furthermore, the capillary force of the gas-liquid exchanging section G may be set to be higher than that of the first occluding body 35B.

In the structure, the first occluding body 35B hardly draws the liquid from the storage chamber unnecessarily at normal temperature. It is therefore possible to delay the timing of saturating the first occluding body 35B with the liquid. The excessive liquid is further transferred to the second occluding body 35A to allow the delay in the timing of saturating the second occluding body 35A with the liquid as much as possible. As the first occluding body 35B hardly draws the liquid unnecessarily, the liquid flow may be stabilized.

In the embodiment, an air passage is formed between the first occluding body 35B and the inner surface of the main body 3, and an air passage is formed between the second occluding body 35A and the inner surface of the main body 3. The air passages are in contact with the gap G of the partition wall 7 via the molded product. This allows externally introduced air to enter into the side of the storage chamber 5 without resistance. Even when using the relatively high viscosity liquid, the application sensitivity may be improved without bringing the application body side into the liquid-rich state.

Figure 11:
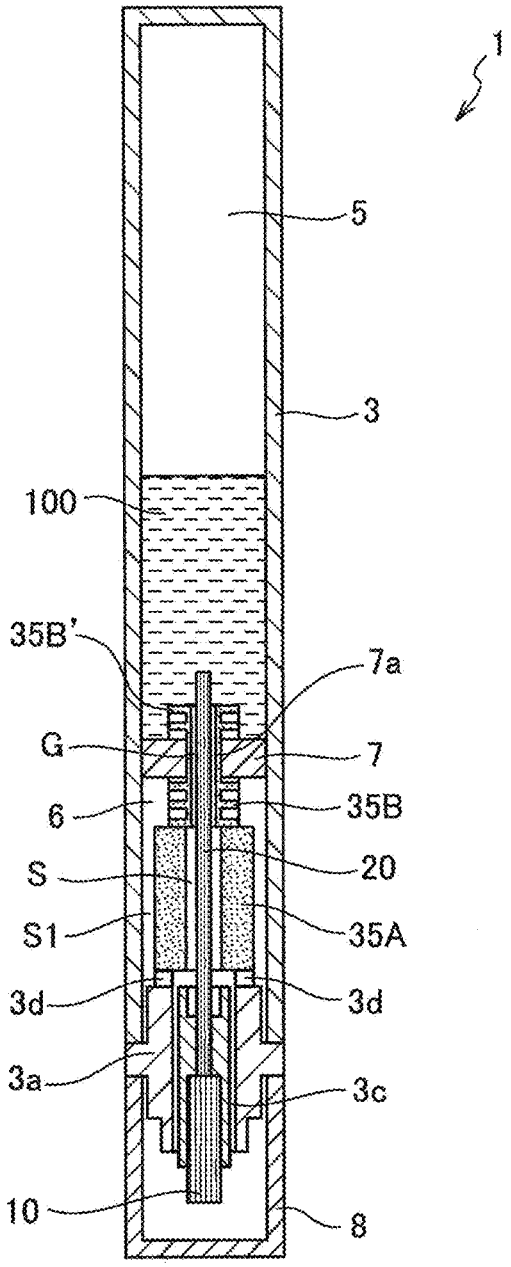
FIG. 11 is a longitudinal sectional view of an eleventh embodiment of an applicator according to the present invention.

FIG. 11 is a view showing an eleventh embodiment of the applicator.

In this embodiment, likewise the structure as shown in FIG. 10, the first occluding body 35B for holding the liquid flowing from the storage chamber side is constituted by the molded product with the partition wall 7, and further includes an occluding body 35B' protruding into the storage chamber 5. The occluding body 35B' protruding into the storage chamber may be integrally formed with the partition wall 7 and the occluding body 35B. The capillary force of the occluding body 35B' is set to be equal to or lower than that of the gas-liquid exchanging section (gap G).

In the structure, the occluding body 35B' disposed in the storage chamber holds the liquid. The liquid overflown from the saturated state is transferred to the first occluding body 35B via the gas-liquid exchanging section (gap G). That is, the occluding body 35B' in the storage chamber serves to reduce the resistance to the liquid moving from the occluding body 35B' to the gap G, and moving from the gap G to the first occluding body 35B, resulting in improved gas-liquid exchanging sensitivity. As the liquid is supplied to the relay core side via the occluding body 35B' saturated first, the first occluding body 35B is hardly saturated in the early stage. This makes it possible to stabilize the application for a prolonged time. In the case of forming the gas-liquid exchanging section G as the gap having the polygonal cross section (a plurality of gaps constituting the gas-liquid exchanging section), the liquid may be held in all the gaps under the capillary force. This makes it possible to stabilize the gas-liquid exchanging function.

Figure 12A:
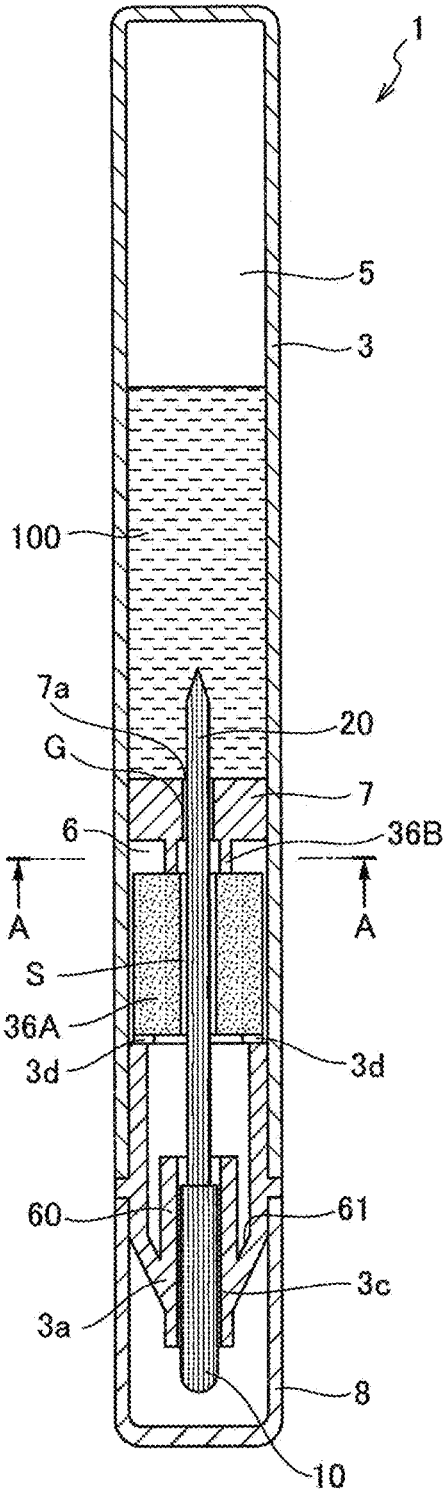
FIGS. 12A and 12B show a twelfth embodiment of an applicator according to the present invention, specifically.
Figure 12B:
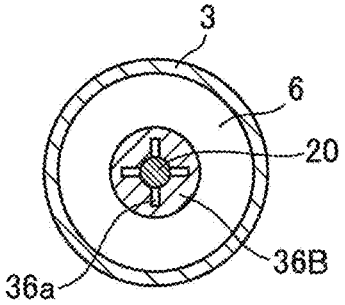

FIGS. 12A and 12B are views showing a twelfth embodiment of the applicator. FIG. 12A is a longitudinal sectional view, and FIG. 12B is a sectional view taken along line A-A.

In this embodiment, provided are a first occluding body 36B disposed in the reservoir chamber 6 while being in contact with the relay member 20 for holding the liquid, and a second occluding body 36A that comes in contact with the first occluding body 36B to allow transfer of the liquid from the first occluding body 36B while being in noncontact with the relay member 20. The first occluding body 36B is constituted by the molded product integrally formed with the partition wall 7, and provided with four longitudinally extending slits 36*a* at each interval of approximately 90°. Each of the slits 36*a* serves to hold the liquid under the capillary force. The number of the slits, the capillary force, and the axial length (liquid storage) may be modified appropriately.

In the structure as described above, each capillary force of the respective slits 36*a* is set to be higher than that of the gap G of the partition wall 7 so that each of the slits serves as the liquid reservoir. Alternatively, if each capillary force of the respective slits 36*a* is set to be lower than that of the gap G of the partition wall 7, the liquid hardly flows to the second occluding body 36A via the slit 36*a* in the normal usage with no temperature change. Therefore, the liquid may be supplied to the application body 10 stably, and saturation of the second occluding body 36A in the early stage may be prevented.

Figure 13:
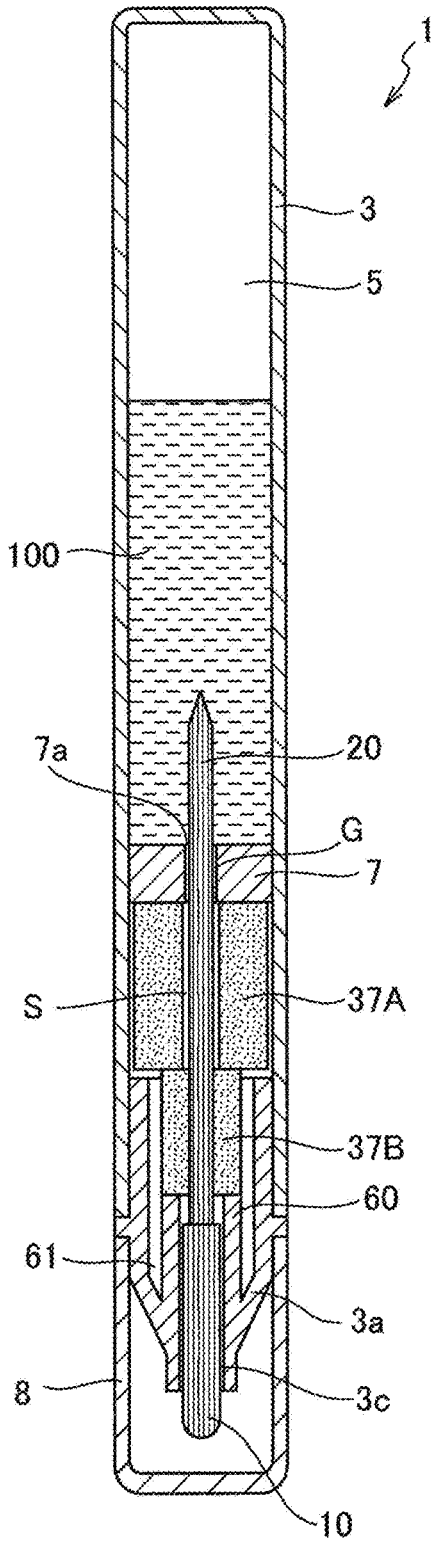
FIG. 13 is a longitudinal sectional view of a thirteenth embodiment of an applicator according to the present invention.

FIG. 13 is a view showing a thirteenth embodiment of the applicator.

In this embodiment, provided are a first occluding body 37B disposed in the reservoir chamber 6 at the application body side while being in contact with the relay member 20 for holding the liquid, and a second occluding body 37A disposed at the partition wall side while being in contact with the first occluding body 37B to allow transfer of the liquid from the first occluding body 37B, and being in noncontact with the relay member 20. In this case, the first occluding body 37B may be constituted by the porous material incorporated with fiber.

As described above, if the occluding body is constituted by the two parts, the positional relation between the occluding body in contact with the relay member 20 and the occluding body in noncontact with the relay member 20 may be appropriately modified.

In the structure as described above, the second occluding bodies 35A, 36A, 37A in noncontact with the relay member 20 may be structured so long as the liquid is not allowed to move from the occluding body to the relay member. As shown in the drawing, the gap S is allowed to intervene between the occluding body and the outer circumferential surface of the relay member 20. It is also possible to apply the outer skin (coated with resin or wax, application of the baking process to the surface) along the axial direction to the outer surface of the relay member 20 and/or the inner surface of the through hole of the occluding body, to which the relay member is fitted.

The embodiments according to the present invention have been described. The present invention is not limited to the embodiments as described above, but may be modified in various ways.

The present invention relates to the occluding body to be disposed in the reservoir chamber, and is characterized in that the movement prevention section is disposed between the occluding body for holding the liquid flowing from the storage chamber, and the relay member that penetrates through the occluding body so that the liquid held in the occluding body does not return to the relay member. For example, the occluding body with the movement prevention section is disposed partially in noncontact with the relay member. Any other structure is not limited to the above-described embodiments. Structures of the gas-liquid exchanging section, the partition wall, the application body and the like may be modified in various ways without being limited to those described above.

Figure 14:
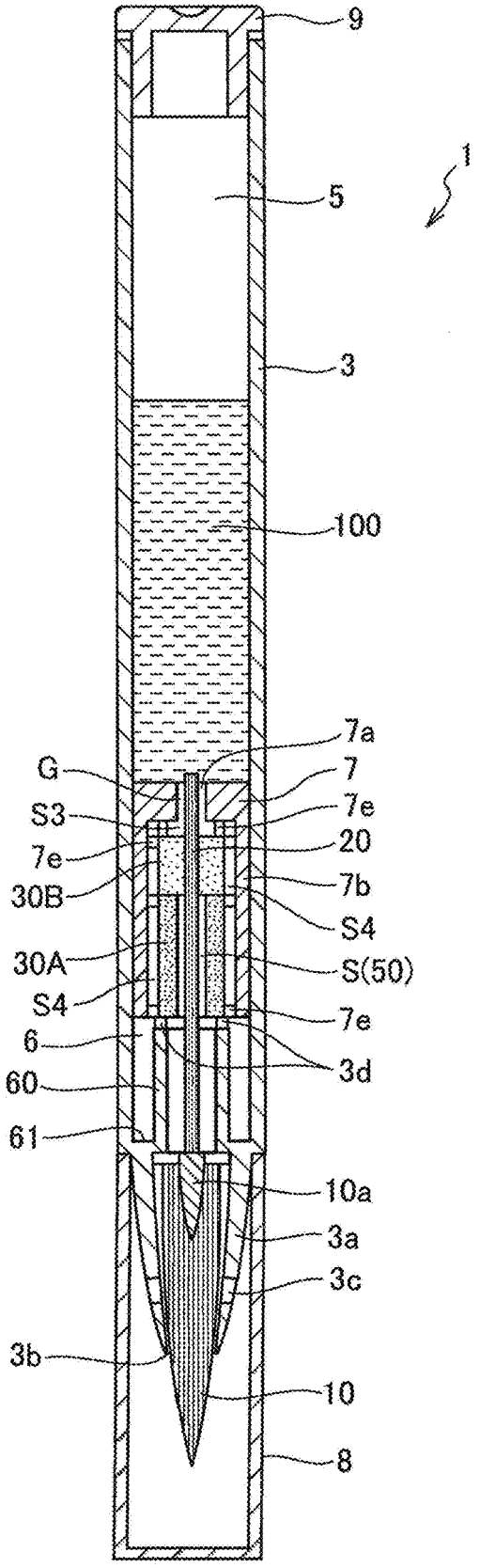
FIG. 14 is a longitudinal sectional view of a modification of the second embodiment.

For example, in the respective embodiments, the occluding body in the reservoir chamber is in contact with the partition wall. However, the gap may be formed between the occluding body and the partition wall. Specifically, likewise the applicator as shown in FIG. 14 (modification of the second embodiment of FIG. 2), the holder 7*b* of the partition wall 7 extends downward, and a plurality of ribs 7*e* are formed on the inner surface of the holder 7*b* so that a gap S3 is formed between the partition wall 7 and the occluding body 30B. Furthermore, a gap S4 may be formed between the radially outside of the occluding bodies 30A and 30B, and the holder 7*b*. Those gaps S3, S4 may be generated by forming the ribs 7*e*, slits, flanges, protrusions or the like on the inner surface of the holder 7*b*. This makes it possible to further intensify the gas-liquid exchanging sensitivity.

Figure 15:
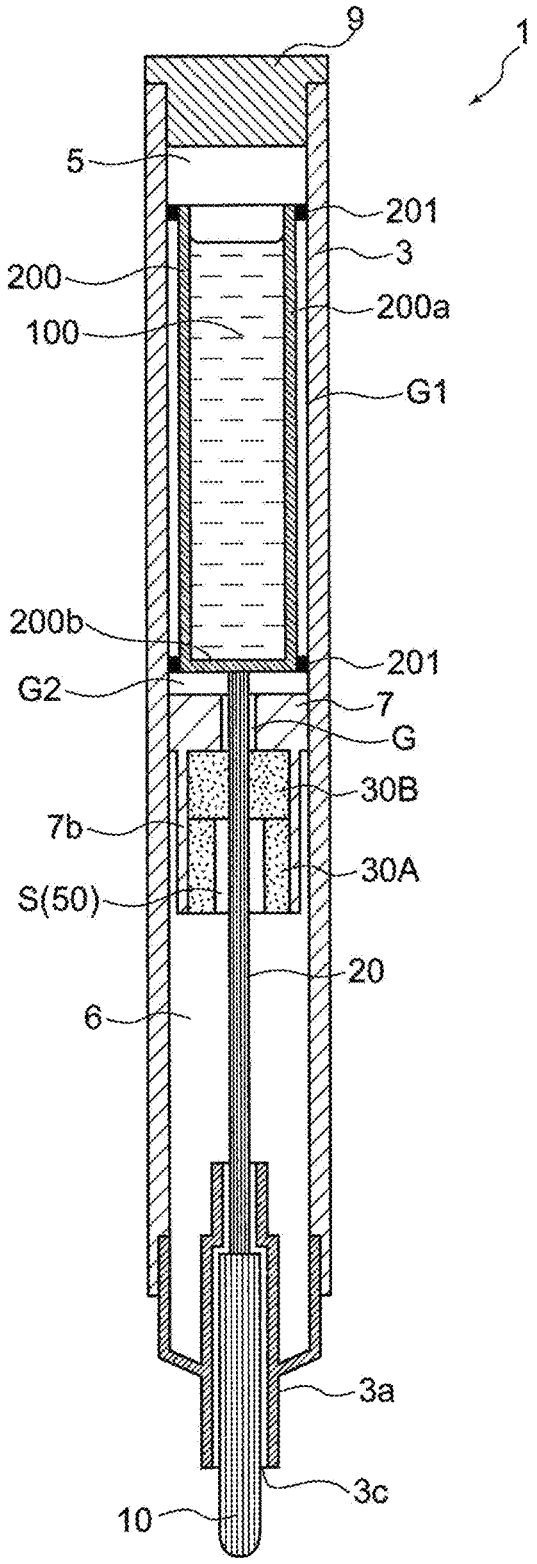
FIG. 15 is a longitudinal sectional view of a fourteenth embodiment of an applicator according to the present invention.

It is possible to dispose the member other than the partition wall, or add the component for imparting various functions to the partition wall. For example, referring to FIG. 15 (fourteenth embodiment), a peripheral wall 200*a* and a bottom wall 200*b* are disposed in the storage chamber 5. The tumbler member 200 for storing the liquid 100 may be disposed in the cylindrical inner space defined by those walls. The tumbler member 200 is structured to have a size that allows formation of a first gap G1 between the inner surface of the main body 3 and the peripheral wall 200*a* for storing the ink, and a second gap G2 between the partition wall 7 and the bottom wall 200*b* for storing the ink. When filling the storage chamber 5 with the liquid 100, the liquid 100 is stored in the inner space of the tumbler member 200 from its upper end opening. The liquid then moves from the upper end opening into the first gap G1, and further to the second gap G2 (the liquid may be moved by changing the posture of the main body 3). An end surface of the relay member 20 protrudes into the second gap G2, and terminates therein.

The tumbler member 200 is configured to be inserted into the main body 3, and fixed thereto. Flanges 201 are protrudingly formed on the outer surface of the peripheral wall 200*a*, which may be in pressure contact with the inner surface of the main body 3. The flanges 201 are formed at both ends of the peripheral wall 200*a* in the axial direction at predetermined intervals (for example, four flanges at each interval of 90°) to allow the liquid 100 to flow into the first gap G1, and to be held stably.

The liquid 100 in the storage chamber is held in the first gap G1 and the second gap G2. In this case, each of the gaps G1, G2 may be configured to hold the liquid under the capillary force, or hold the liquid without using the capillary force (the liquid is held by changing the posture to allow movement of the liquid). The liquid may be held in the gaps G1, G2 under the capillary force. Therefore, even if the application body 10 is used (for writing) while being directed upward, the liquid 100 is held in the gaps G1, G2 to allow the stable writing. In order to hold the liquid in the gaps G1, G2 under the capillary force, the size and location of the tumbler member 200 may be set so that the capillary force of the second gap G2 becomes larger than that of the first gap G1.

As the tumbler member 200 is disposed in the storage chamber, it is possible to suppress a large quantity of liquid from being pushed out to the reservoir chamber side in spite of the temperature change or application of forceful impact. This makes it possible to prevent saturation of the occluding bodies 30B, 30A in the early stage. When the liquid held in the relay member 20, and the gaps G, G1, G2 is entirely used up, the liquid to be supplied to the relay member 20 is exhausted. In such a case, the posture of the main body 3 is changed by temporarily turning the side of the tail plug 9 downward so that the liquid 100 stored in the tumbler member 200 is held in the gaps G, G1, G2 again.

The embodiments may be implemented by replacing the component of one embodiment with the one of the other embodiment, or combining the components. In the embodiments, the cosmetic tool such as the eyeliner has been described as an exemplified case. However, the present invention is applicable to various applicators such as the writing tool.

The invention claimed is:

1. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein the movement prevention section is an outer skin applied over an outer surface of the relay member along an axial direction.

2. The applicator according to claim 1, wherein the storage chamber, the reservoir chamber, the partition wall, the occluding body, and the relay member are disposed in a refill to be attached to or detached from the main body.

3. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein the movement prevention section is a gap formed between an outer surface of the relay member and the occluding body along an axial direction.

4. The applicator according to claim 3, wherein:

the occluding body formed of one part or two parts has a high porosity region and a low porosity region along the axial direction; and the movement prevention section is formed in at least a part of the high porosity region.

5. The applicator according to claim 4, wherein the high porosity region of the occluding body is located at a side of the application body.

6. The applicator according to claim 3, wherein:

the occluding body formed of one part or two parts has a high porosity region and a low porosity region along the axial direction; and the movement prevention section is formed in at least a part of the low porosity region.

7. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein:

the partition wall has a through hole into which the relay member is inserted with a gap;

the gas-liquid exchanging section is formed as the gap between the through hole and the relay member; and a capillary force of the gas-liquid exchanging section is set to be equal to or lower than a capillary force of a low porosity region of the occluding body.

8. The applicator according to claim 7, wherein the through hole formed in the partition wall forms the gas-liquid exchanging section in abutment on the relay member at two or more points.

9. The applicator according to claim 7, wherein:

the relay member inserted into the through hole has its end terminated in the storage chamber, and the end in contact with the occluding body formed of the porous material incorporated with a fiber in the storage chamber; and a capillary force of the occluding body is set to be equal to or lower than a capillary force of the occluding body.

10. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein the partition wall has a through hole into which the relay member is inserted with a gap;

the gas-liquid exchanging section is formed as the gap between the through hole and the relay member; and a capillary force of the gas-liquid exchanging section is set to be higher than a capillary force of the occluding body.

11. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein the relay member is separated in the axial direction in the occluding body in a region where the movement prevention section is not formed.

12. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

an occluding body that is disposed in the reservoir chamber, and in contact with the relay member for occluding the liquid; and a movement prevention section disposed at the relay member and/or the occluding body to prevent movement of the liquid held in the occluding body to the relay member, wherein an annular liquid outflow prevention wall is disposed in the reservoir chamber to form a bottom section between the liquid outflow prevention wall and the main body, and to enclose the relay member.

13. An applicator comprising:

a main body;

a storage chamber disposed in the main body for storing a liquid;

a reservoir chamber disposed in the main body to allow the liquid flowing from the storage chamber to be held;

a partition wall for partitioning between the storage chamber and the reservoir chamber;

an application body disposed at an end of the main body to allow application of the liquid stored in the storage chamber;

a relay member that transfers the liquid stored in the storage chamber passing through the partition wall toward the application body;

a gas-liquid exchanging section formed at the partition wall for performing gas-liquid exchanging with the liquid stored in the storage chamber;

a first occluding body that is disposed in the reservoir chamber, and has at least a part in contact with the relay member for holding the liquid; and a second occluding body that is in contact with the first occluding body to allow transfer of the liquid from the first occluding body, and in noncontact with the relay member.

14. The applicator according to claim 13, wherein the first occluding body is a molded product, and the second occluding body is formed of a porous material incorporated with a fiber.

15. The applicator according to claim 14, wherein the first occluding body is integrally formed with the partition wall.

16. The applicator according to claim 15, wherein the first occluding body protrudes into the storage chamber.

17. The applicator according to claim 13, wherein:

the partition wall has a through hole into which the relay member is inserted with a gap; and the gas-liquid exchanging section is formed as the gap between the through hole and the relay member.

18. The applicator according to claim 17, wherein the through hole formed in the partition wall forms the gas-liquid exchanging section in abutment on the relay member at two or more points.

19. The applicator according to claim 17, wherein a capillary force of the first occluding body is set to be higher than a capillary force of the second occluding body; and a capillary force of the gas-liquid exchanging section is set to be equal to or lower than the capillary force of the first occluding body.

20. The applicator according to claim 17, wherein a capillary force of the first occluding body is set to be lower than a capillary force of the second occluding body; and a capillary force of the gas-liquid exchanging section is set to be higher than the capillary force of the first occluding body.

21. The applicator according to claim 13, wherein an annular liquid outflow prevention wall is disposed in the reservoir chamber to form a bottom section between the liquid outflow prevention wall and the main body, and to enclose the relay member.

* * * * *